United States Patent [19]

Murasaki

[11] 4,396,276

[45] Aug. 2, 1983

[54] ELECTRONIC COPYING MACHINE

[75] Inventor: Hiroshi Murasaki, Sakai, Japan

[73] Assignee: Minolta Camera Kabushiki Kaisha, Osaka, Japan

[21] Appl. No.: 300,973

[22] Filed: Sep. 9, 1981

[30] Foreign Application Priority Data

Sep. 9, 1980 [JP] Japan ..... 55-125663

[51] Int. Cl.[3] ..... G03G 15/00; G03G 15/08

[52] U.S. Cl. ..... 355/15; 355/3 DD; 355/14 R; 355/14 D; 355/620; 355/652; 355/125

[58] Field of Search ..... 355/15, 3 DD, 14 D, 355/3 R, 14 R; 430/125, 120; 118/620, 652

[56] References Cited

U.S. PATENT DOCUMENTS

| | | | |
|---|---|---|---|
| 3,611,982 | 10/1971 | Coriale et al. | 118/4 |
| 3,848,993 | 11/1974 | Hasiotis | 355/15 |
| 3,877,413 | 4/1975 | Rowell et al. | 118/7 |
| 4,110,033 | 8/1978 | Ophey | 355/14 R |
| 4,154,522 | 5/1979 | Ikesue | 355/15 |
| 4,215,931 | 8/1980 | Tsuda et al. | 355/14 R |
| 4,247,196 | 1/1981 | Ogawa et al. | 355/15 |
| 4,252,434 | 2/1981 | Nakamura et al. | 355/15 |

*Primary Examiner*—A. C. Prescott

*Attorney, Agent, or Firm*—Wenderoth, Lind & Ponack

[57] ABSTRACT

An electronic copying machine having an image bearing member movable past a station for transferring an image on the image bearing surface thereof to copying paper. A blade member is provided which is movable between a position in which it is pressed in contact with the image bearing surface of the image bearing member for removing toner therefrom and a position in which it is spaced from the surface by a blade moving device. A control is connected to the blade drive, the blade moving device and a toner depositing device for controlling these devices for, prior to a copying operation, moving the blade member to the position spaced from the surface of the image bearing member, depositing toner on the surface of the image bearing member, driving the image bearing member until the toner bearing portion thereof has reached the position where the blade member contacts the image bearing member, and then moving the blade member to the position where it is pressed in contact with the image bearing member.

6 Claims, 12 Drawing Figures

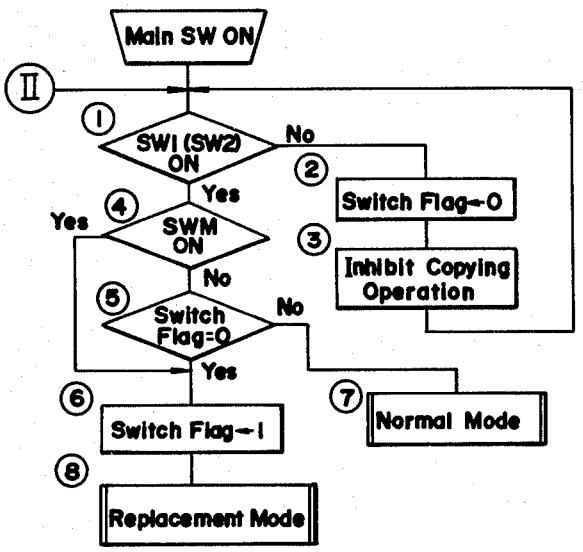
FIG. 7
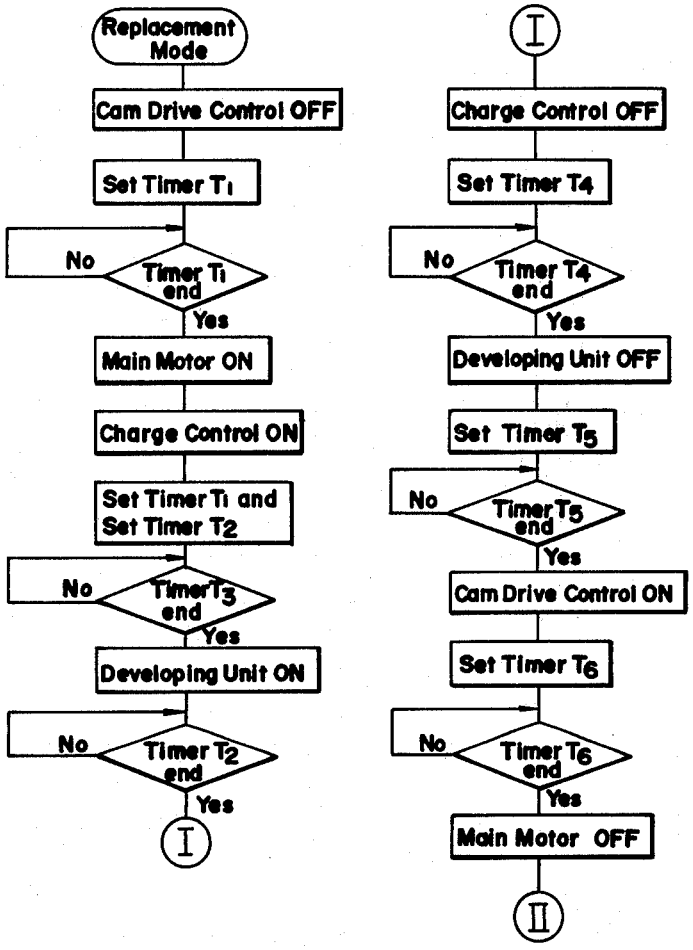

ELECTRONIC COPYING MACHINE

BACKGROUND OF THE INVENTION

1. Field of the Invention

The present invention relates to an electronic copying machine equipped with a cleaner of the blade type.

2. Description of the Prior Art

As shown in FIG. 1*a*, conventional blade-type cleaners for electronic copying machines comprise a blade member 2 of polyurethane rubber or like elastic material which is held pressed in contact with the surface of the photoconductive drum 1 to scrape residual toner off the surface of the drum 1 during the rotation of the drum 1.

In such blade type cleaners, the blade member is adapted to be pressed against the surface of the photoconductive drum by a constant force to clean the drum surface effectively. During cleaning, the blade member must be held in suitable sliding contact with the drum surface to avoid damage to the drum surface or to the blade member. This is assured by suitably determining the force to achieve the desired pressing contact of the blade member, hardness of the rubber, the angle of contact of the member, etc. However, such conditions are usually determined according to the frictional force to be obtained by the contact between the drum and the blade member during use, so that, for example, when the drum or the blade member is replaced by a new one or when the machine is started into operation for the first time (this state will hereinafter be referred to as the "initial state"), an abnormally great friction function is likely to act between the drum surface and the blade member without permitting the desired sliding contact. Especially when a selenium-type photoconductive drum is placed into use for the first time, the drum surface, which is nearly specular, produces a great frictional force. In such an initial state, the drum or blade member is liable to be damaged, to produce abnormal noises or to develop other troubles. Thus the initial operation involves a serious problem.

With respect to damage to the blade edge, when a blade is pressed against a photoconductive drum, there is ideally line contact therebetween, but because the material of the blade is somewhat compressed, there is actually surface-to-surface contact of the blade with the drum (see FIG. 1*b*), whereupon surface attraction between the two members causes them to tend to adhere to each other. When the drum is rotated in this state, a maximum force of static friction is produced due to the friction between the two members, causing the blade edge portion to undergo plastic deformation exceeding the elastic limit of polyurethane rubber and thus rupture (FIG. 1*c*). The heat of evolved at this time due to the friction further deforms the blade. These phenomena cause damage to the blade edge. Surface contact is more likely to occur when the drum has a specular surface and also when the blade edge has a lower hardness.

The edge portion of such a blade has been examined microscopically, and it has been found that the edge had developed a roughness of about 20 to about 30$\mu$ over the entire length thereof.

With respect to abnormal noise, when undergoing plastic deformation as described above (FIG. 1*c*), there is an abnormally increased force of friction produced, acting to brake the drum against rotation and creating an abnormal noise. Accordingly the damage to the blade and the abnormal noise are concurrent.

The damage to the blade further tends to mar and damage the surface of the drum.

SUMMARY OF THE INVENTION

The main object of the present invention is to overcome the foregoing problems, and to this end there has been provided an electronic copying machine having a blade member which is prevented from being subjected to an excessive force in the initial state of operation.

When an image bearing member such as a photoconductive drum and a blade member are placed into use for the first time, an abnormal frictional force will be produced between the image bearing member and the blade member. The present invention reduces the frictional force by utilizing the effect of the toner which itself acts to reduce the frictional force, so that there is no necessity to subject the blade member or the like to special antifriction treatment. This invention therefore has various useful advantages. The effect achieved by the invention can be enhanced when an antifriction agent is incorporated in the developer.

This frictional force reduction is achieved according to the present invention by providing an electronic copying machine having a cleaner of the blade type characterized in that before one or both of the image bearing member and blade member adapted to be pressed into contact with the image bearing member are placed into use, an operation mode can be executed prior to a copying operation, the operation mode comprising depositing toner on a portion of the surface of the image bearing member while the blade member is held away from the surface and pressing the blade member into contact with the surface of the image bearing member after the toner bearing portion of the image bearing member has reached the location of the blade member.

Stated more specifically, the object of the present invention can be fulfilled by detecting that a photoconductive drum serving as the image bearing member or a blade member has been replaced or newly installed, depositing toner on the drum when the drum is subsequently rotated by (i) subjecting the drum at least to charging and development or by (ii) applying a bias voltage of the same polarity as the toner to a developing unit to subject a portion of the drum to development (without charging), and holding the blade member away from the drum at least until the developed portion reaches the cleaning location.

Frictional force between the blade and the drum is reduced by the invention because, as shown in FIG. 2, when the surface of a photoconductive drum 1 is developed with toner T, a uniform layer of toner T is formed on the drum surface, and when a blade 2 is then pressed against the drum 1 by being pressed against the layer, the blade 2 rests on the layer without coming into surface-to-surface contact with the drum during drum rotation, i.e. without any surface attraction being created. Thus the blade undergoes no plastic deformation. As the drum is further rotated, the toner acts as a lubricant, reducing the kinetic friction at the blade edge portion and reducing the heat due to friction.

The edge portion of a blade such as the blade 2 in FIG. 2 has been examined microscopically and the edge has been found to be free of any damage over the entire length thereof.

BRIEF DESCRIPTION OF THE DRAWINGS

FIG. 7 shows a flow chart of the processing procedures executed by a control micro-computer system;

DESCRIPTION OF THE PREFERRED EMBODIMENTS

Embodiments of the invention will be described below with reference to the drawings.

Figure 1A:
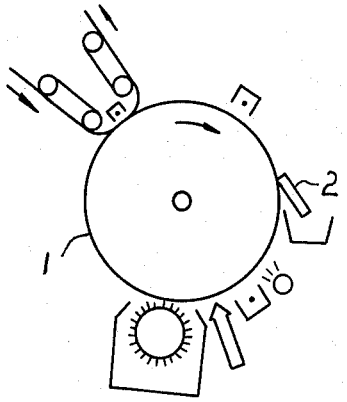
FIG. 1*a* is a schematic representation of an electronic copying machine to which the present invention is to be applied.
Figure 1B:
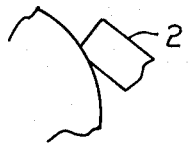
FIG. 1*b* is a diagram showing a blade edge adhered by surface attraction to a photoconductive drum when the drum is in a stationary state.
Figure 1C:
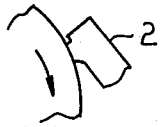
FIG. 1*c* is a diagram showing a rupture produced in the blade edge when rotation of the drum is initiated.
Figure 2:
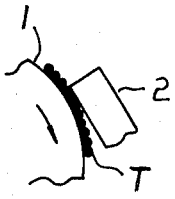
FIG. 2 is a diagram showing the principle of the invention.
Figure 3:
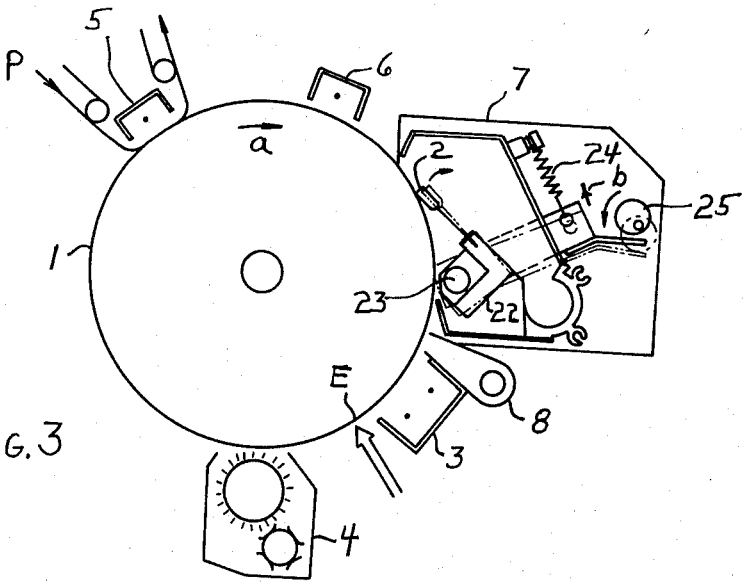
FIG. 3 is a diagrammatic representation of the construction of a copying machine according to the invention.

FIG. 3 shows an electronic copying machine according to a first embodiment of the invention. A photoconductive drum 1 rotatably supported for rotation in the direction of the arrow a has positioned around the periphery thereof a sensitizing charger 3, a developing unit 4, a transfer charger 5, an erasing or presensitizing charger 6, a cleaner 7, an erasing lamp 8, etc. arranged one after another. A toner image corresponding to an optical image projected onto the drum at an exposure station E is transferred onto paper P fed in timed relation to the rotation of the drum 1. The toner remaining on the drum surface after the transfer is scraped off by a blade member 2 of the cleaner 7 so that the drum 1 can be used again.

The cleaner 7 comprises the above-described blade member 2 made of polyurethane rubber or like elastic material, a support plate 21, such as a metal plate, having the blade member 2 supported on the forward end, a holder 22 holding the support plate 21 and pivotally supported on a pivot 23, a spring 24 biasing the holder 22 in the direction of an arrow b for pressing the blade member 2 against the surface of the drum 1, and cam means 25 for moving the blade member 2 away from the drum surface against the force of the spring 24. The cam mmeans 25, when operated as described later, controls movement of the blade member 2 into and out of contact with the drum surface. The means for supporting and moving the blade member 2 can be modified suitably.

Figure 4:
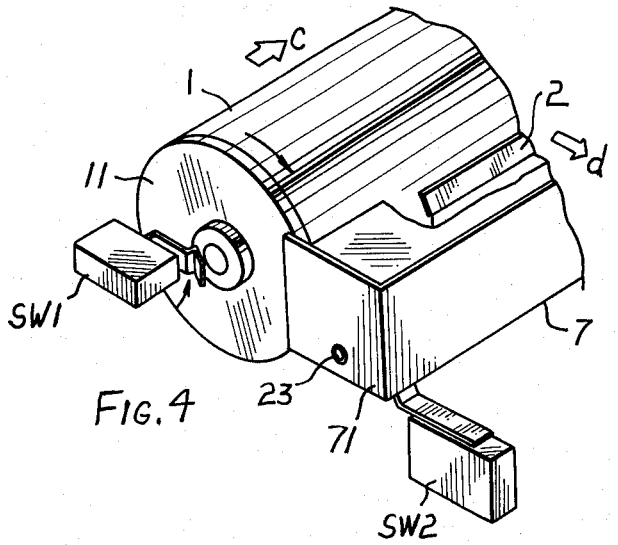
FIG. 4 is a fragmentary perspective view of the machine of FIG. 3.

FIG. 4 shows switches SW1 and SW2 for detecting when the photoconductive drum 1 and the cleaner 7 are installed or removed, i.e. whether the drum and the cleaner are present or absent. In FIG. 4 the drum 1 is removable in the direction of arrow c, and the cleaner 7 in the direction of arrow d. When they are removed, the switches SW1 and SW2 are changed over respectively. The switch SW1 is so positioned that its actuator contacts a flange portion 11 of the drum 1 when the drum 1 is in its proper installed position to hold the actuator in its depressed position, which indicates that the drum 1 is installed. The switch SW2 is so positioned that when the casing 71 of the cleaner 7 is in its proper installed position, the actuator thereof is held depressed for detecting that the cleaner is in the installed position. As will be described later, the switches SW1 and SW2 are used for detecting whether the drum 1 or cleaner 7 is installed or has been removed and are caused to emit a signal for setting an operation mode when replacement of the drum or blade has taken place.

Figure 5:
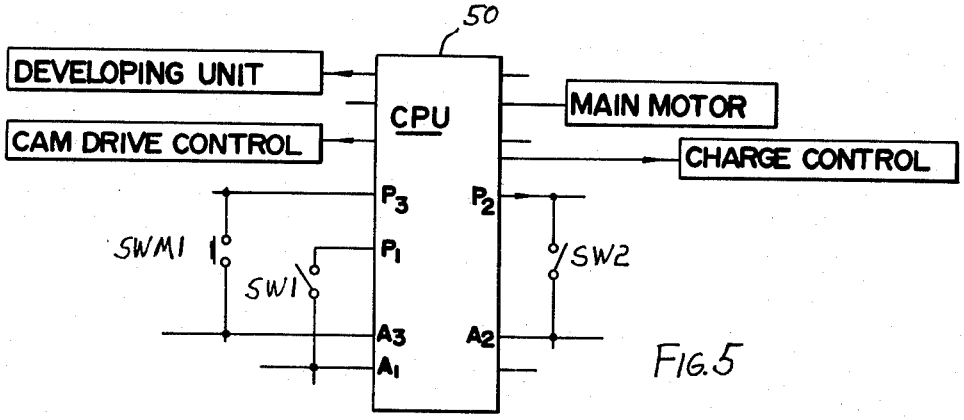
FIG. 5 is a circuit diagram showing the relation between a control microcomputer system and detecting switches.

FIG. 5 shows the relation between the switches SW1 and SW2, etc. and a central processing unit (hereinafter referred to as a "CPU") 50 of a microcomputer for the sequential control of the copying machine and for other purposes. The CPU 50 receives signals from unillustrated detecting means within the copying machine and from unillustrated switch means, etc. for setting the number of copies, density of copy images, copying magnification, etc. and produces programmed control signals in response to these input signals.

As described above, the CPU 50 produces programmed control signals among which are detecting signals for the switch means. For detecting whether or not the drum 1 is in position, a detecting signal is produced at an output P1 at a specified time. If the switch SW1 is closed, the signal is transmitted to an input A1, indicating that the drum 1 is in position. If the switch SW1 is open at the time of the production of the detecting signal, no signal will reach input A1 and this indicates that the drum 1 has been removed for replacement. The detecting signal may be emitted by the CPU 50 once for every routine of the program to monitor the drum position at all times, or may be delivered only when desired, for example, when the drum is replaced. Similarly, whether or not the cleaner 7 is in position is detected by delivering a detecting signal from an output P2 to an input port A2 via the switch SW2.

If the switch SW1 or SW2 is detected as being open while the machine is in use in the usual manner, the CPU 50 detects the absence of the drum 1 or the blade member 2 of the cleaner 7 and stops the machine from carrying out the copying operation. When the switch SW1 or SW2 is again closed, and then the main switch or print switch is subsequently turned on, a replacement mode operation is executed automatically.

Figure 6:
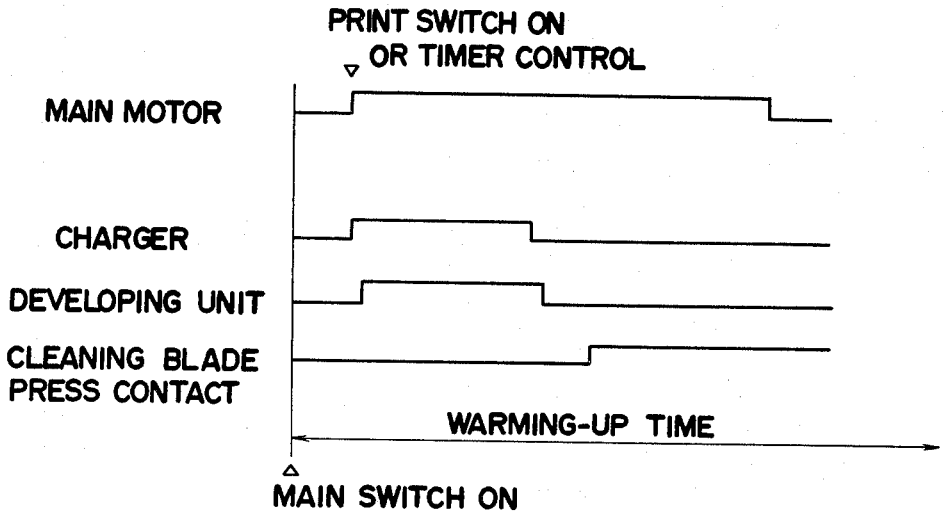
FIG. 6 is a time chart showing a specific example of the replacement mode.

Control procedures carried out by the CPU 50 in regard to the replacement mode will be described below in connection with the time chart of FIG. 6 and the flow chart of FIG. 7.

When the main switch is turned on, the switch SW1 (or SW2, hereinafter the same) is checked as to whether it is turned on or not in step (1) in the flow chart. If it is turned off, the sequence proceeds to steps (2) and (3), in which the switch flag is set to "0" and the copier is inhibited from carrying out a copying operation. If both switches SW1 and SW2 are turned on, the sequence proceeds to step (4), in which a manual switch SWM is checked as to whether it is turned on or not. If it is turned off, the sequence proceeds to step (5), in which the switch flag is checked as to whether it is set to "0" or not. If it is set to "1", the sequence proceeds to step (7), in which the copier is set to operate in a normal mode. If it is set to "0", the sequence proceeds to steps (6) and (8), in which the switching flag is set to "1" and the copier is set to operate in the replacement mode. That is, when the photoconductive drum 1 or the cleaner 7 is to be replaced, the switch SW1 or SW2 is first turned off and then turned on when replacement is completed. Accordingly, OFF-ON operation of the switch SW1 or SW2 will when detected indicate that the replacement mode should be carried out. When a manual switch SWM is held depressed in step (4), the replacement mode is indicated regardless of whether switches SW1 and SW2 have been turned on and then off.

The replacement mode will be described in detail.

With the blade member 2 moved away from the drum surface by the operation of the cam means 25 (Cam Drive Control OFF), a timer $T_1$ is set. At the end of the time set on the timer $T_1$, the main motor is turned on to drive the drum 1 and at the same time, the sensitizing charger 3 is turned on while timers $T_2$ and $T_3$ are set.

The timer $T_2$ controls the timing to turn off the sensitizing charger 3 and the timer $T_3$ controls the timing to turn on the developing unit 4. At the end of the time set on the timer $T_2$, the sensitizing charger 3 is turned off and in turn, a timer $T_4$ is set.

The timer $T_4$ controls the timing to turn off the developing unit 4.

At the end of the time set on the timer $T_4$, the developing unit 4 is turned off and in turn, a timer $T_5$ is set. The timer $T_5$ controls the time for which the blade member 2 is brought into pressing contact with the surface of drum 1 by the cam means 25.

This pressing contact is effected at least after the charged and developed portion of the drum surface has reached the location of the pressing portion of the blade member 2.

This is to say that at the end of the time set on the timer $T_5$, the blade member 2 is brought into pressing contact with the drum surface and a timer $T_6$ is set in turn. The timer $T_6$ controls the timing for completing the replacement mode and turns off the main motor.

These timers $T_1$ to $T_6$ have set values in correspondence with a program utilizing a timing source such as a reference clock pulse of a micro-computer. Structurally, a RAM, register and other conventional elements of a micro-computer are used. References should be made to U.S. Pat. Nos. 4,280,763 and 4,211,482 for a general understanding of Normal Mode and the general relationship between the copying apparatus and the micro-computer.

Figure 8:
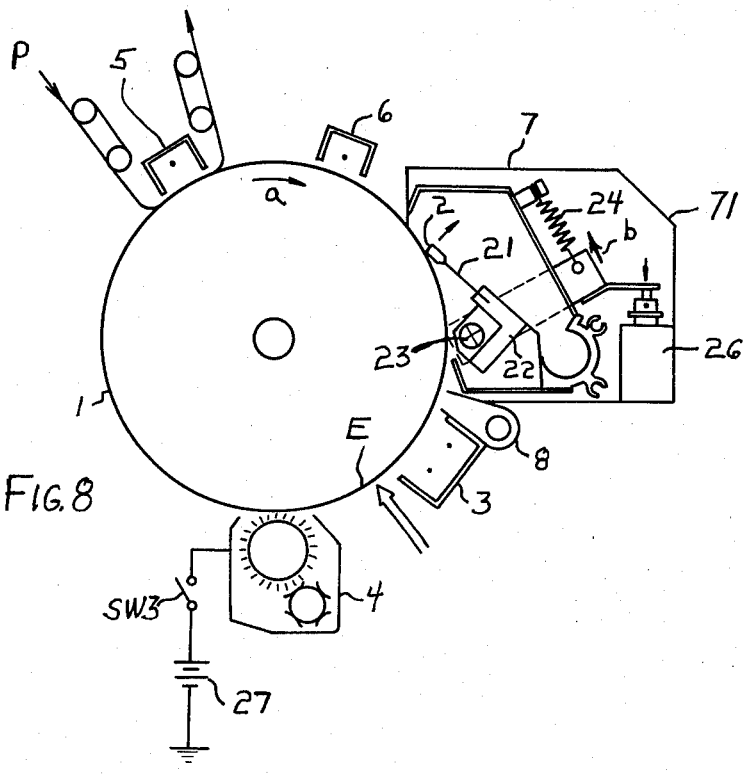
FIG. 8 is a diagrammatic representation of the construction of another copying machine according to the invention.

FIG. 8 shows another electronic copying machine according to the present invention, in which the cam means 25 of FIG. 3 is replaced by a solenoid 26 for controlling movement of the blade member 2 into and out of contact with the drum surface. Furthermore a bias voltage source 27 for applying a voltage having the same polarity as toner T is connected to the developing unit 4 via a bias switch SW3 which is turned on and off with a timing to be described later. Instead of charging the photoconductive drum in the controlled mode described with reference to FIG. 3, a voltage of about 100 to about 150 V is applied across the developing unit 4 and the drum 1 when the switch SW3 is on to uniformly deposit the toner T on the surface of the drum 1. With the exception of these features, the second embodiment has the same construction as the first. Thus the switches SW1 and SW2 for detecting whether the drum 1 and the cleaner 7 are installed or have been removed are exactly the same as those shown in FIG. 4.

Figure 9:
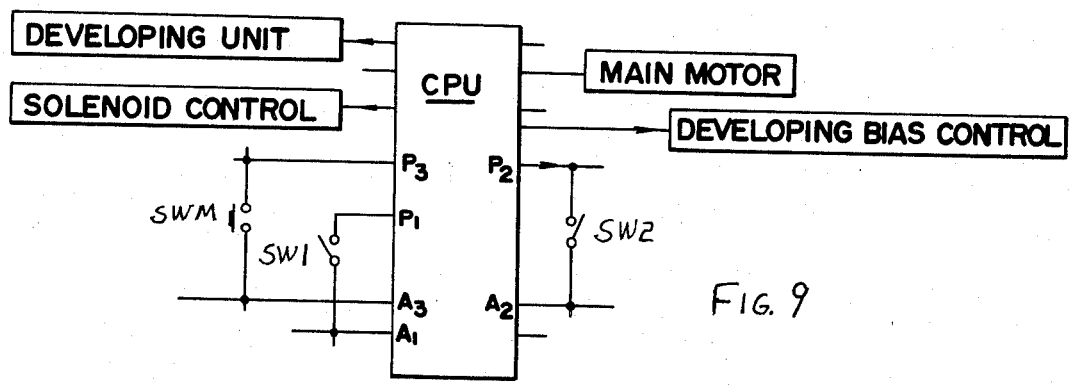
FIG. 9 is a circuit diagram showing the relation between a control microcomputer system and detecting switches in the copying machine of FIG. 8.

FIG. 9 shows a circuit for sequentially controlling the second embodiment. The circuit is the same as the one shown in FIG. 5 with the exception of means for effecting solenoid control and developing bias control instead of the cam control and charging control shown in FIG. 5.

Figure 10:
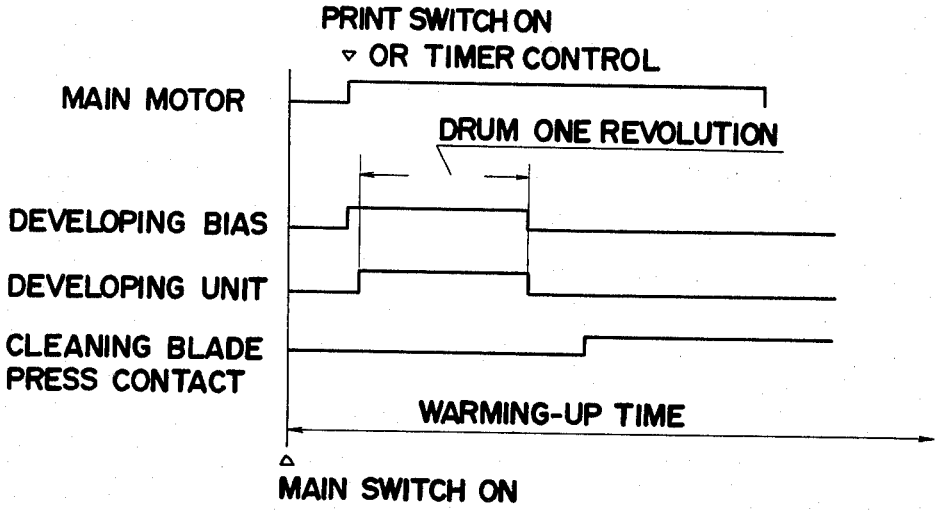
FIG. 10 is a time chart showing a specific example of the replacement mode for the copying machine of FIG. 8.

The replacement mode operation for the embodiment of FIG. 9 is an operation such as is shown in the time chart of FIG. 10. With the blade member 2 moved away from the drum surface by the energization of the solenoid 26, the print switch is turned on, whereby the main motor is turned on to drive the drum 1 and, at the same time, the developing bias switch SW3 is turned on to cause the bias voltage source 27 to apply a voltage of the same polarity as the toner T to the developing unit 4. The developing unit 4 is then turned on to deposit the toner T on the surface of the drum 1. When the drum 1 is thereafter rotated through one turn, the unit 4 is turned off, and the switch SW3 is also turned off at the same time. Thus the toner T is applied to the drum 1 uniformly over the entire periphery thereof. Subsequently the solenoid 26 is de-energized to allow the spring 24 to urge blade member 2 into pressing contact with the drum surface. The drum 1 is further rotated through at least one turn. The machine is thereafter maintained in a standby position. The blade member 2 is of course pressed against the drum surface at a controlled time such that the member 2 will contact the developed portion of the drum surface.

Furthermore a flow chart of the replacement mode is the same as the one shown in FIG. 7 with the exception of means for effecting solenoid control and developing bias control instead of the cam control and charging control in FIG. 7.

The replacement mode operation described for the foregoing two embodiments may be executed by turning on the manual switch SWM only while the machine is in use, for example, when the blade member 2 produces a frictional noise even if the drum 1 or the blade member 2 has not been replaced, or when part of the drum surface remains free from deposited toner for a prolonged period of time, such as when copying at a reduced scale.

While the replacement mode operation is adapted to prevent abnormal frictional force from occurring between the drum surface and the blade member 2 in an initial state by operating the drum 1, sensitizing charger 3, developing unit 4 and cleaner 7 in the case of the first embodiment or by operating the drum 1, bias voltage source 27 through the developing bias switch SW3, developing unit 4 and cleaner 7 in the second embodiment, the replacement mode operation can be used for other initial conditions involving adverse effects due to the sensitivity of the photoconductive drum or humidity. To eliminate such effects especially when replacing the drum 1, the drum 1 and the chargers 3 and 6 and the erasing lamp 8 only may be operated after the foregoing operation as part of the replacement mode operation.

Although the copying machine in the above two embodiments are the type wherein an electrophotographic photoconductive member is subjected to the steps of charging, exposure, development and image transfer, the present invention is also useful for copying machines using a process comprising forming an electrostatic image on a photoconductive member by charging and exposure, forming on the surface of a dielectric member an electrostatic image corresponding to the image, developing the image on the dielectric member and transferring the toner image. In this case, the toner image bearing member is a dielectric drum, against which the blade member is pressed to remove the residual toner after the image transfer. Accordingly the replacement mode operation to be executed comprises the steps of depositing the toner on the dielectric drum and bringing the blade member into pressing contact with the dielectric surface after the toner bearing portion has reached the location of the blade member.

I claim:

1. An electronic copying machine comprising:

an image bearing member movable past a station for transferring an image on the image bearing surface thereof to copying paper;

drive means for driving said image bearing member;

a blade type cleaner having a blade member movable toward and away from said image bearing member between a position in which said blade member is pressed in contact with said image bearing surface of said image bearing member for removing toner therefrom and a position in which said blade member is spaced from said surface of said image bearing member;

blade moving means connected to said blade type cleaner for moving said blade member to one or the other of said positions;

said image bearing member and said blade member being removably mounted in said copying machine;

presence detecting means engaged by at least one of said members for giving an indication of whether said detecting means has been disengaged and then reengaged;

toner depositing means for depositing toner on the image bearing surface of said image bearing member; and control means connected to said drive means, said blade moving means and said toner depositing means and said presence detecting means for controlling said drive means, said blade moving means and said toner depositing means for, when said presence detecting means indicates that it has been disengaged and then reengaged, moving said blade member to the position in which it is spaced from said surface of said image bearing member, depositing toner on said surface of said image bearing member, driving said image bearing member until the toner bearing portion thereof has reached the position where said blade member contacts said image bearing member, and then moving said blade member to the position where said blade member is pressed in contact with said image bearing member.

2. An electronic copying machine as claimed in claim 1 wherein said toner depositing means comprises means for charging the image bearing surface of said image bearing member, and means for supplying toner to said charged surface.

3. An electronic copying machine as claimed in claim 2 in which said control means comprises means for first starting said driving means, then starting said charging means, then starting said toner supplying means, thereafter turning said charging means off, then turning said toner supplying means off, and then turning said blade moving means on for moving said blade member to said one position in which it is pressed in contact with said image bearing member.

4. An electronic copying machine as claimed in claim 1 wherein said toner depositing means comprises means for supplying toner to the image bearing surface of said image bearing member, and means for applying a bias voltage of the same polarity as the toner to said toner supplying means.

5. An electronic copying machine as claimed in claim 4 in which said control means comprises means for first starting said driving means, then energizing said means for applying the bias voltage, then starting said toner supplying means, then simultaneously turning said means for applying the bias voltage and the toner supplying means off, and then turning said blade moving means on for moving said blade member to said one position in which it is pressed in contact with said image bearing member.

6. An electronic copying machine as claimed in claim 1 wherein said presence detecting means further comprises means for detecting the presence or absence of the image bearing member and/or the blade member and connected to said control means for causing said control means to prevent operation of said machine when said image bearing member and/or said blade member is detected as being absent.

* * * * *